US008495828B1

(12) United States Patent
Feldman et al.

(10) Patent No.: US 8,495,828 B1
(45) Date of Patent: Jul. 30, 2013

(54) CANVAS STRETCHING LOCKING PLIERS WITH GRIPPING ELEMENTS AND FULCRUM EXTENSION

(76) Inventors: Arthur Feldman, Monrovia, CA (US); Marty Gray, Laguna Beach, CA (US)

( * ) Notice: Subject to any disclaimer, the term of this patent is extended or adjusted under 35 U.S.C. 154(b) by 193 days.

(21) Appl. No.: 13/164,650

(22) Filed: Jun. 20, 2011

(51) Int. Cl.
*D06C 3/08* (2006.01)
*B25B 7/02* (2006.01)

(52) U.S. Cl.
USPC ..... 38/102; 294/16; 81/420

(58) Field of Classification Search
USPC ..... 38/102–102.91; 294/16; 81/418–421; D8/52, 58
See application file for complete search history.

(56) References Cited

U.S. PATENT DOCUMENTS

| | | | | |
|---|---|---|---|---|
| 126,818 | A | 5/1872 | Lindsay | |
| 902,570 | A | 11/1908 | Ellis | |
| 2,528,229 | A | 10/1950 | Kelly | |
| 2,555,133 | A * | 5/1951 | Horstmann | 606/116 |
| 2,608,793 | A | 9/1952 | Grant | |
| 3,169,034 | A * | 2/1965 | Epstein | 294/16 |
| 3,367,703 | A * | 2/1968 | Pittis | 294/16 |
| 4,181,046 | A | 1/1980 | Lamb | |
| 4,305,575 | A * | 12/1981 | Bardes | 269/41 |
| 4,386,542 | A * | 6/1983 | Verna | 81/420 |
| 4,471,543 | A | 9/1984 | Wolsey | |
| 4,747,588 | A * | 5/1988 | Dillhoff | 269/6 |
| 5,387,308 | A | 2/1995 | Heavrin | |
| 5,902,015 | A * | 5/1999 | Allcock | 297/463.1 |
| 6,983,524 | B2 | 1/2006 | Eastwood | |
| 7,306,274 | B2 | 12/2007 | Renny | |
| D605,917 | S * | 12/2009 | Sands | D8/52 |

FOREIGN PATENT DOCUMENTS

| | | |
|---|---|---|
| FR | 2616110 | 12/1988 |
| FR | 2688673 | 9/1993 |

* cited by examiner

*Primary Examiner* — Ismael Izaguirre
(74) *Attorney, Agent, or Firm* — Michael I. Kroll

(57) ABSTRACT

Canvas stretching locking pliers having upper and lower lateral plates disposed on the jaws thereof with the upper lateral plate having a plurality of pointed prongs for crimping the canvas and the lower lateral plate having corresponding prong apertures for receiving the prongs and canvas therein. A fulcrum extension is provided on the lower lateral plate for placement against the stretcher bar wherein lowering the articulating arms of said locking pliers pulls the canvas in a regulated manner without overstretching.

14 Claims, 10 Drawing Sheets

CANVAS STRETCHING LOCKING PLIERS WITH GRIPPING ELEMENTS AND FULCRUM EXTENSION

BACKGROUND OF THE INVENTION

1. Field of the Invention

The present invention relates generally to mounting tools and, more specifically, to a canvas stretching tool for stretching and mounting a canvas to a stretcher frame in a taut, uniform manner without overstretching the canvas.

2. Description of the Prior Art

There are other stretching devices designed for mounting a canvas. While these devices may be suitable for the purposes for which they were designed, they would not be as suitable for the purposes of the present invention as heretofore described.

It is thus desirable to provide a canvas stretching tool for pulling a canvas taut against a picture frame during the mounting process comprising locking pliers with a pair of articulating arms terminating in lateral jaw plates with the underside of one jaw plate having a plurality of prong elements projecting therefrom and the other jaw plate having a plurality of prong apertures corresponding with said prongs for grasping the canvas firmly during the stretching thereof.

It is further desirable to provide a canvas stretching tool wherein the lower jaw plate includes a fulcrum extension extending forwardly from the front portion thereof that is placed against the frame when the tool is angled into a raised position and pulls the canvas as it is lowered.

SUMMARY OF THE PRESENT INVENTION

A primary object of the present invention is to provide canvas stretching locking pliers to stretch a canvas across a stretching frame uniformly without overstretching the canvas.

Another object of the present invention is to provide canvas stretching locking pliers having a pair of articulating arms having lateral plates disposed on the jaws thereof.

Yet another object of the present invention is to provide canvas stretching locking pliers having gripping elements disposed on the lateral plates.

Still yet another object of the present invention is to provide canvas stretching locking pliers wherein the gripping elements are a plurality of prongs on the upper lateral plate and corresponding apertures for receiving the prongs on the lower plate.

An additional object of the present invention is to provide canvas stretching locking pliers having a fulcrum extension projecting from the front of the lower lateral plate.

A further object of the present invention is to provide canvas stretching locking pliers wherein the fulcrum extension regulates the degree of stretching of the canvas throughout the mounting process.

A yet further object of the present invention is to provide canvas stretching locking pliers wherein the fulcrum extension increases the ease of stretching the canvas across the stretcher frame.

A still yet further object of the present invention is to provide canvas stretching locking pliers wherein the lower lateral plate and fulcrum extension provide means for positioning the fulcrum extension abutting a desired corner to obtain tight corners in preparing gallery wraps.

An additional object of the present invention is to provide canvas stretching locking pliers where the lower lateral plate and fulcrum extension provide means for positioning the fulcrum extension abutting a desired corner having 45 degree support extending between adjoining frame sides to obtain tight corners in preparing gallery wraps.

Additional objects of the present invention will appear as the description proceeds.

The present invention overcomes the shortcomings of the prior art by providing canvas stretching locking pliers having upper and lower lateral plates disposed on the jaws thereof with the upper lateral plate having a plurality of pointed prongs for crimping the canvas and the lower lateral plate having corresponding prong apertures for receiving the prongs and canvas therein. A fulcrum extension is provided on the lower lateral plate for placement against the stretcher strip wherein lowering the articulating arms of said locking pliers pulls the canvas in a regulated manner without overstretching.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
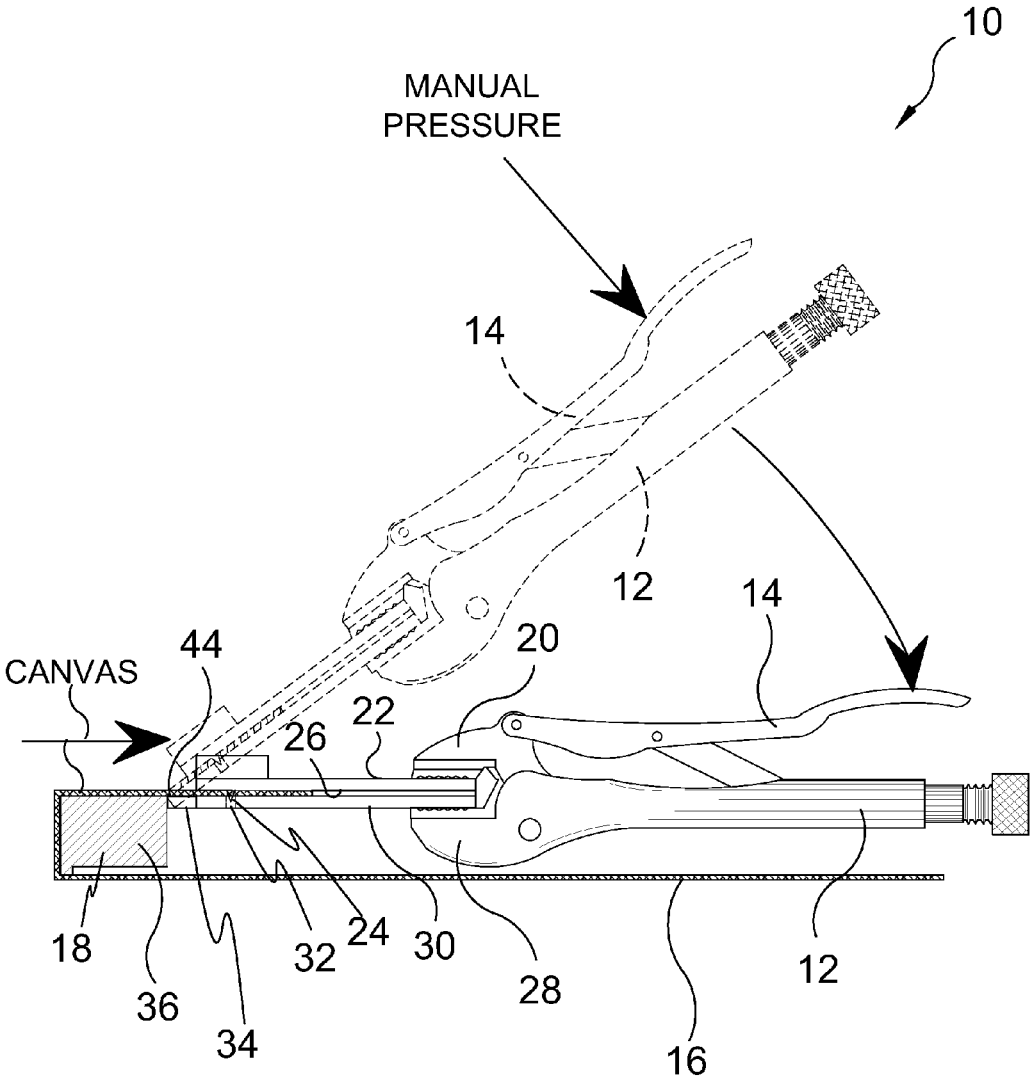
FIG. 1 is an illustrative view of present invention.

Turning now descriptively to the drawings, in which similar reference characters denote similar elements throughout the several views, the figures illustrate the Canvas Stretching Locking Pliers with Gripping Elements and Fulcrum Extension of the present invention. With regard to the reference numerals used, the following numbering is used throughout the various drawing figures.

10 Canvas Stretching Locking Pliers with Gripping Elements and Fulcrum Extension of the present invention

12 lower stationary arm

14 upper pivoting locking arm

16 canvas

18 stretcher frame

20 upper jaw

22 upper lateral plate
24 prong
26 underside of 22
28 lower jaw
30 lower lateral plate
32 prong aperture
34 fulcrum extension member
36 stretcher bar
38 base portion of 24
40 top portion of 22
42 raised bar of 22
44 front upper edge of 34

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of present invention. The present invention is canvas stretching locking pliers 10 having a lower stationary arm 12 and an upper pivoting locking arm 14 for stretching fabric, such as canvas 16, onto a frame structure such as a stretcher frame 18 prior to fastening the material to the stretcher bar 36 of the frame. The two hinged arms terminate in an upper jaw 20 with an integral upper lateral plate 22 having a plurality of prongs 24 disposed on the underside 26 thereof and a lower jaw 28 with an integral lower lateral plate 30 having a plurality of prong apertures 32 corresponding to said prongs 24. The prongs 24 pierce the canvas 16 and penetrate the apertures 32 when the jaws close. It is also an object of the invention that the fabric stretcher tool incorporates arm means for locking the tool when in a closed state and arm means for unlocking the tool to an open state when desired. Also shown is the lower lateral plate 30 having a fulcrum extension member 34 forming fulcrum for stretching the canvas 16 over the stretcher bar 36 of the stretcher frame 18. The front upper edge 44 of the fulcrum extension 34 is placed against the stretcher bar 36 and the canvas 16 is stretched as the pliers are lowered to a horizontal position.

Figure 2:
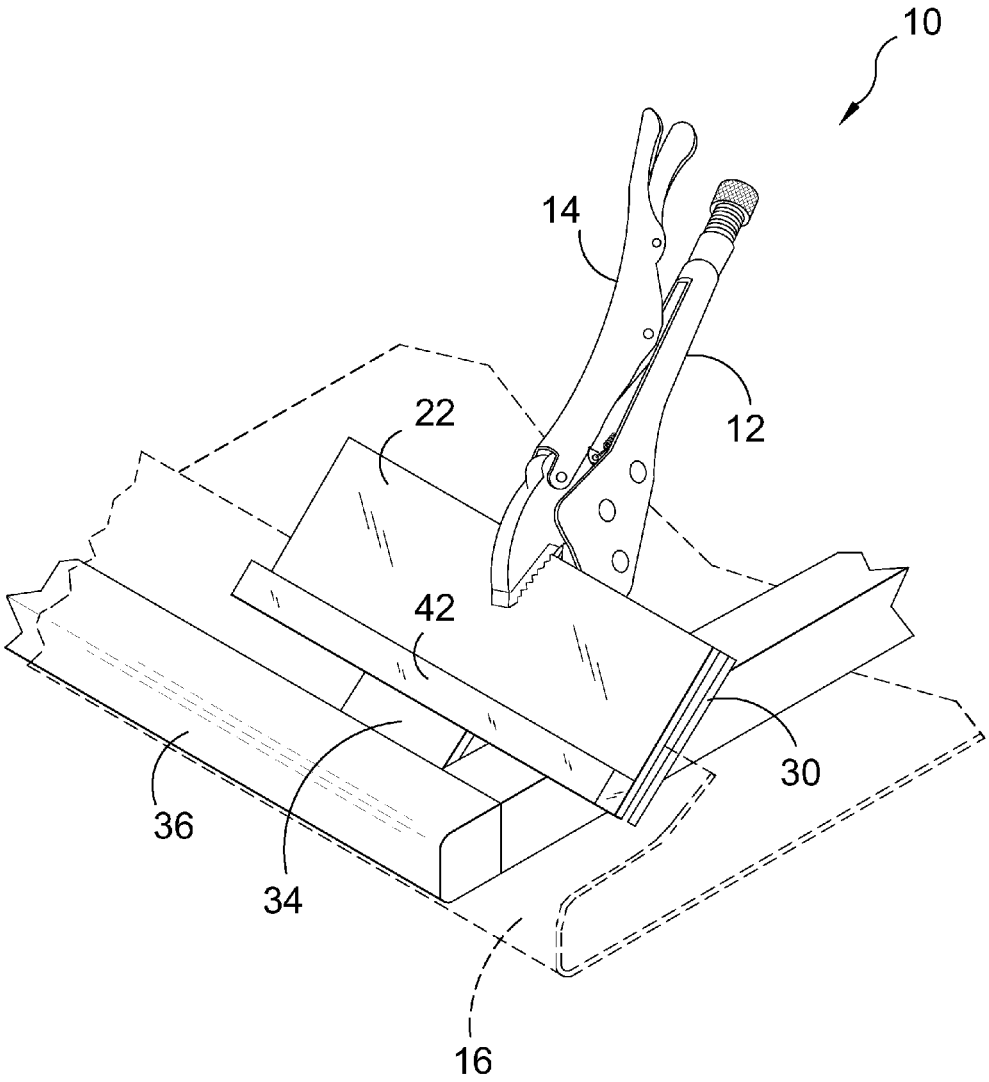
FIG. 2 is a perspective view of the present invention in use.

FIG. 2 is a perspective view of the canvas stretching locking tool for stretching a canvas across a stretcher bar. Shown is the tool comprising vice grip style canvas stretching locking pliers 10 comprising articulated arm 12 having lateral plate 30 affixed thereto with fulcrum extension member 34 extending therefrom and pivoting locking arm 14 having upper lateral plate 22 affixed thereto with canvas 16 securely held between the lateral plates. Also shown is the tool being used to in preparing a gallery wrap, where lateral plate 30 having fulcrum extension 34 provides for positioning the fulcrum extension member 34 abutting a corner of the stretcher bar 36 to tighten canvas 16 in a first direction for fastening to the stretcher bar. Then the canvas is cut or folded with the tool 10 moved to the adjoining side and the procedure repeated for stretching the canvas for fastening to the stretcher frame thereby providing nice tight corners for the gallery wrap.

Figure 3:
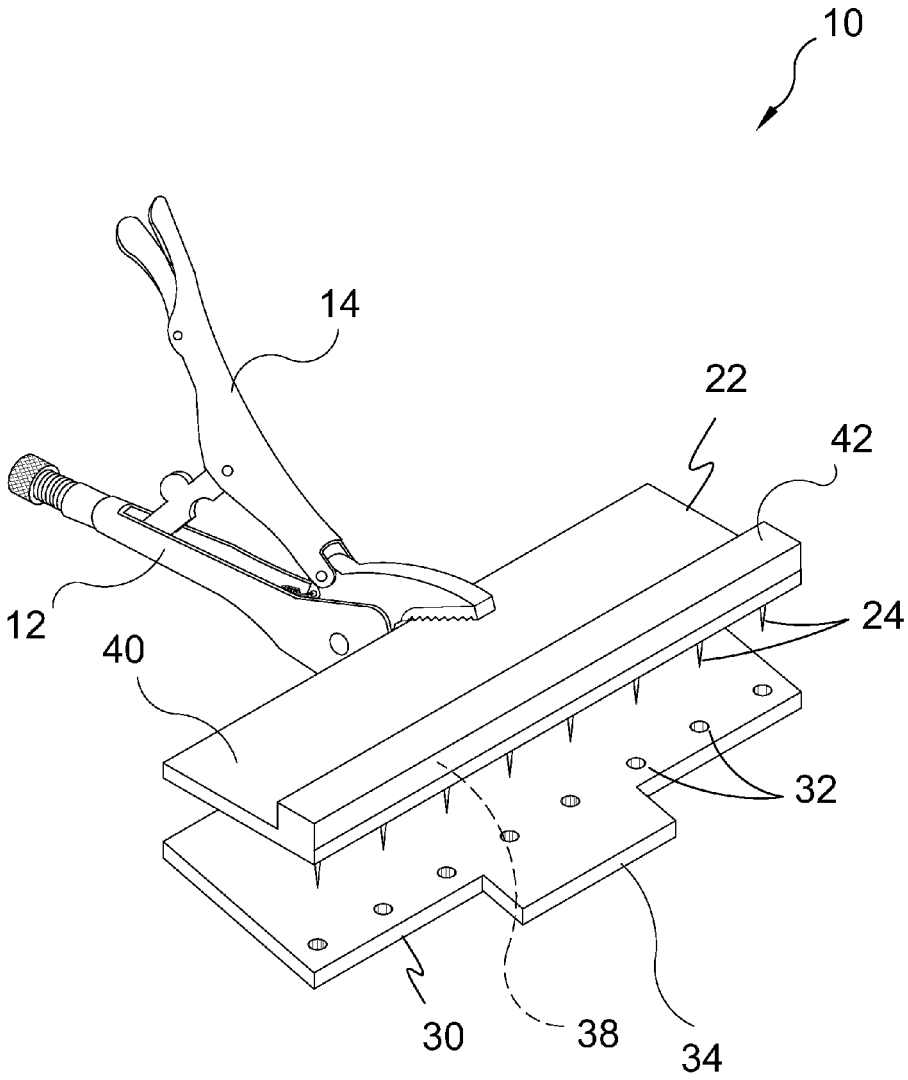
FIG. 3 is a perspective view of the present invention.

FIG. 3 is a perspective view of the present invention. Shown is a perspective view of canvas stretching locking pliers 10 in an open position comprising a lower stationary arm 12 and an upper, pivoting locking arm 14 terminating in an upper lateral plate 22 having a plurality of spaced prongs 24 with the base portions 38 embedded in a raised bar 42 disposed on the top portion 40 thereof substantially aligned along the front portion of the plate and correspondingly mating prong apertures 32 of the lower lateral plate 30 for receiving the opposing plate prongs 24. Further provided is the lower lateral plate 30 having a fulcrum extension 34 providing for regulating the pressure applied to the fabric across the leading edge.

Figure 4:
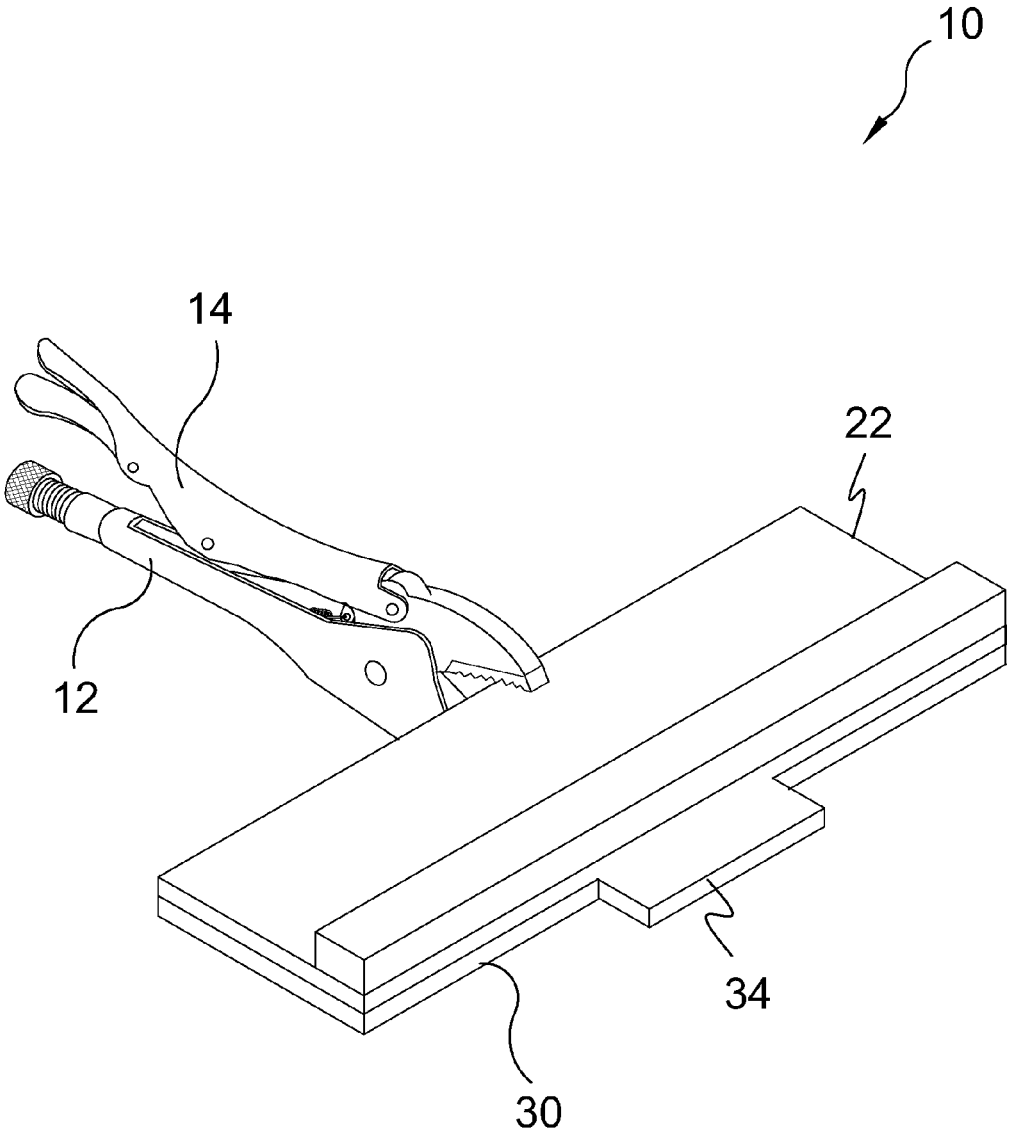
FIG. 4 is a perspective view of the present invention.

FIG. 4 is a perspective view of the present invention. Illustrated is a perspective view of the canvas stretching locking pliers 10 in a closed position showing the upper pivoting locking arm 14 in the closed and locked position relative to the lower stationary arm 12 with the upper lateral plate 22 compressed in face to face relation and the fulcrum extension 34 projecting beyond the edges thereof.

Figure 5:
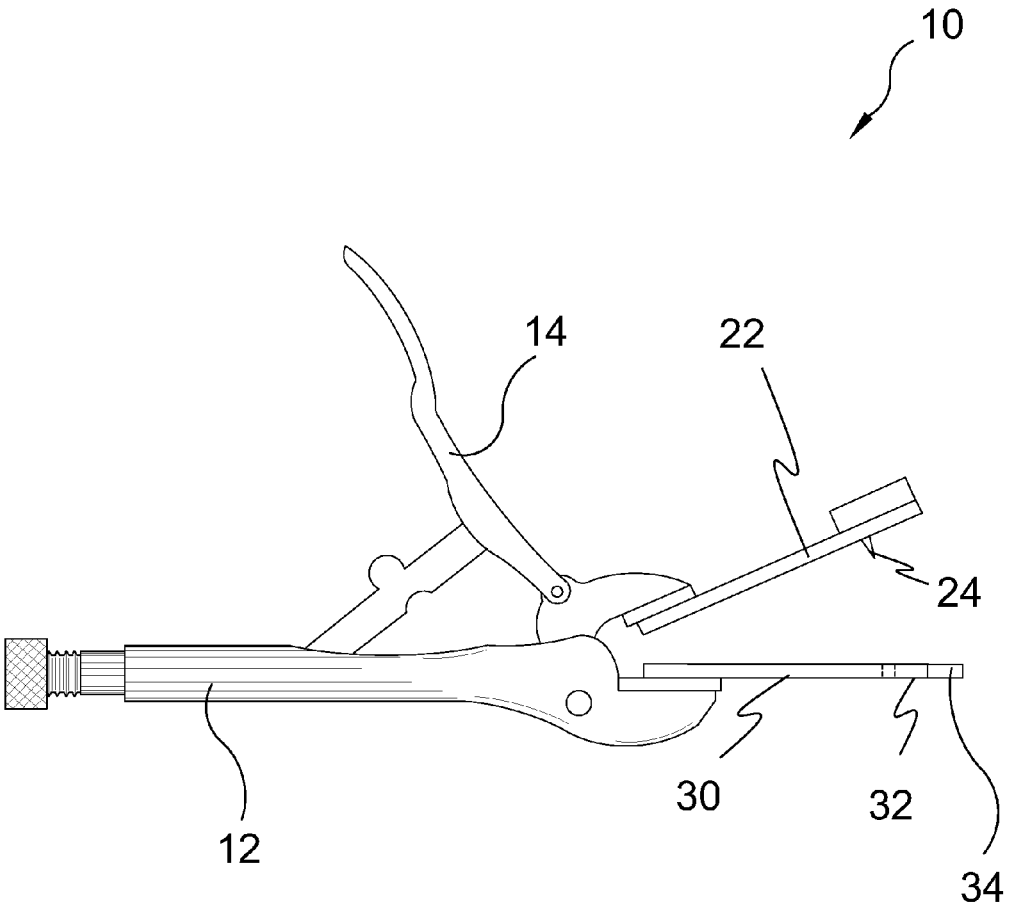
FIG. 5 is a side view of the present invention.

FIG. 5 is a side view of the present invention. Shown is a side view of the canvas stretching locking pliers 10 in an open position comprising a lower stationary arm 12 terminating in a lower lateral plate 30 having a plurality of spaced prong apertures 32 substantially aligned along the front portion of the plate and corresponding with the prongs 24 of the upper lateral plate 22 related with the upper, pivoting locking arm 14. Further provided in one of the plates having a fulcrum extension 34 there by varying the pressure applied to the fabric across the leading edge.

Figure 6:
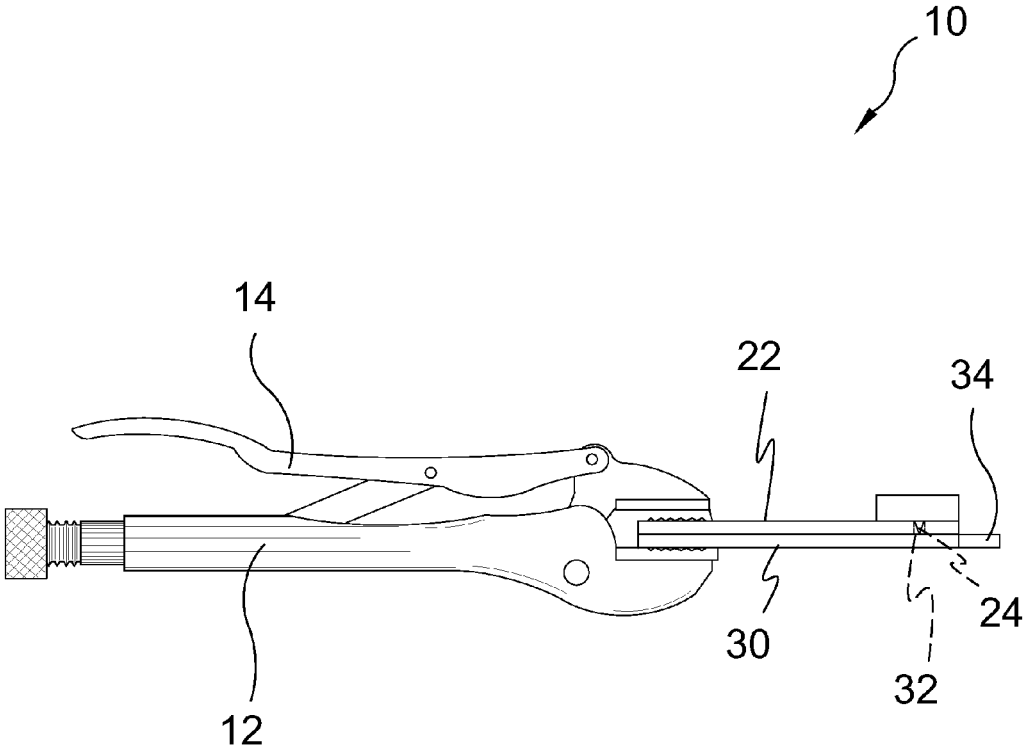
FIG. 6 is a perspective view the present invention.

FIG. 6 is a side view of the present invention. Shown is a side view of the canvas stretching locking pliers 10 in a closed position comprising a lower stationary arm 12 terminating in a lower lateral plate 30 having a plurality of spaced prong apertures 32 substantially aligned along the front portion of the plate and corresponding with the prongs 24 of the upper lateral plate 22 related with the upper, pivoting locking arm 14. Further provided in one of the plates having a fulcrum extension 34 there by varying the pressure applied to the fabric across the leading edge.

Figure 7:
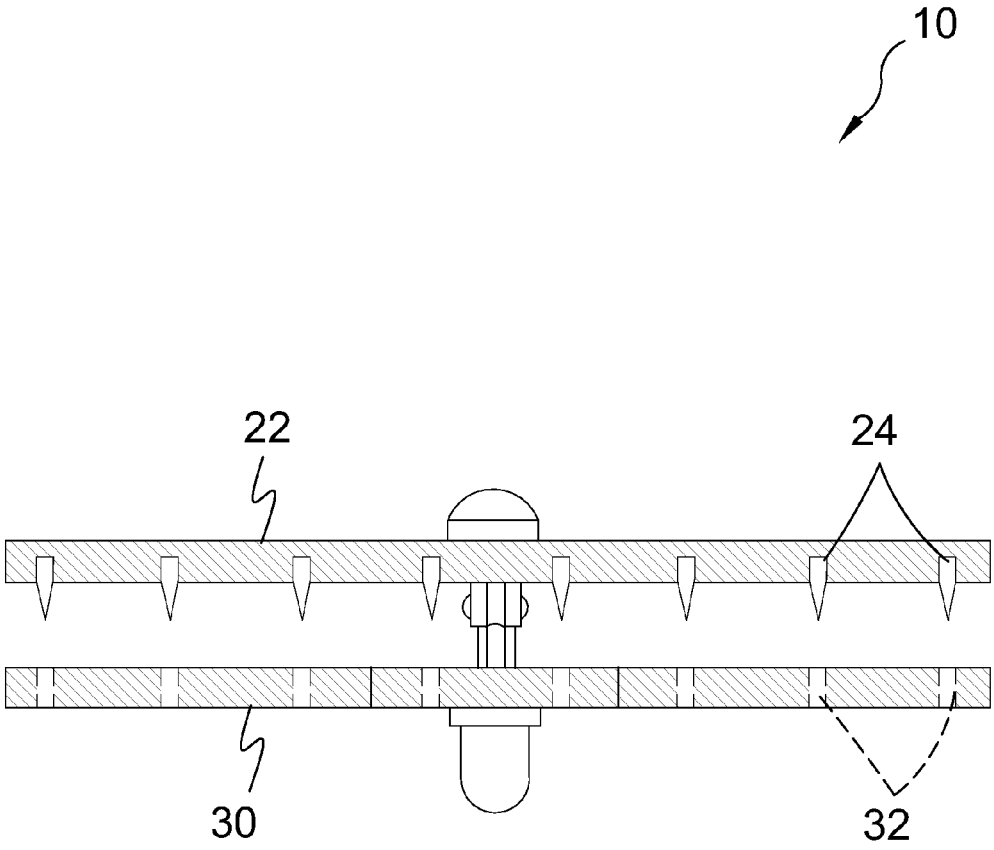
FIG. 7 is a front view of the present invention.

FIG. 7 is a front view of the present invention. Shown is the canvas stretching locking pliers 10 with the upper lateral plate 22 and the lower lateral plate 30 separated into the open position and the prongs 24 aligned with the prong apertures 32.

Figure 8:
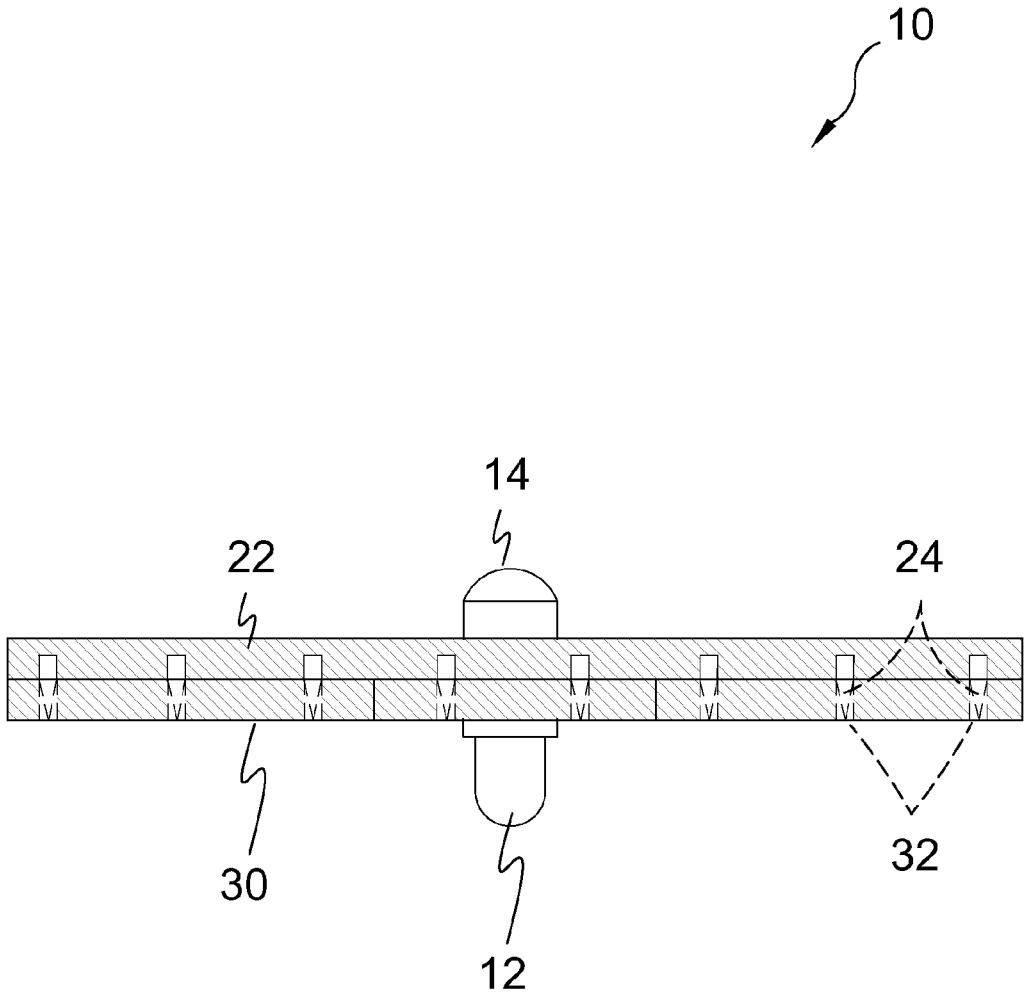
FIG. 8 is a front sectional view of the present invention.

FIG. 8 is a front sectional view of the present invention. Shown is the canvas stretching locking pliers 10 with the upper lateral plate 22 and the lower lateral plate 30 clamped into the closed position and the prongs 24 inserted within the prong apertures 32.

Figure 9:
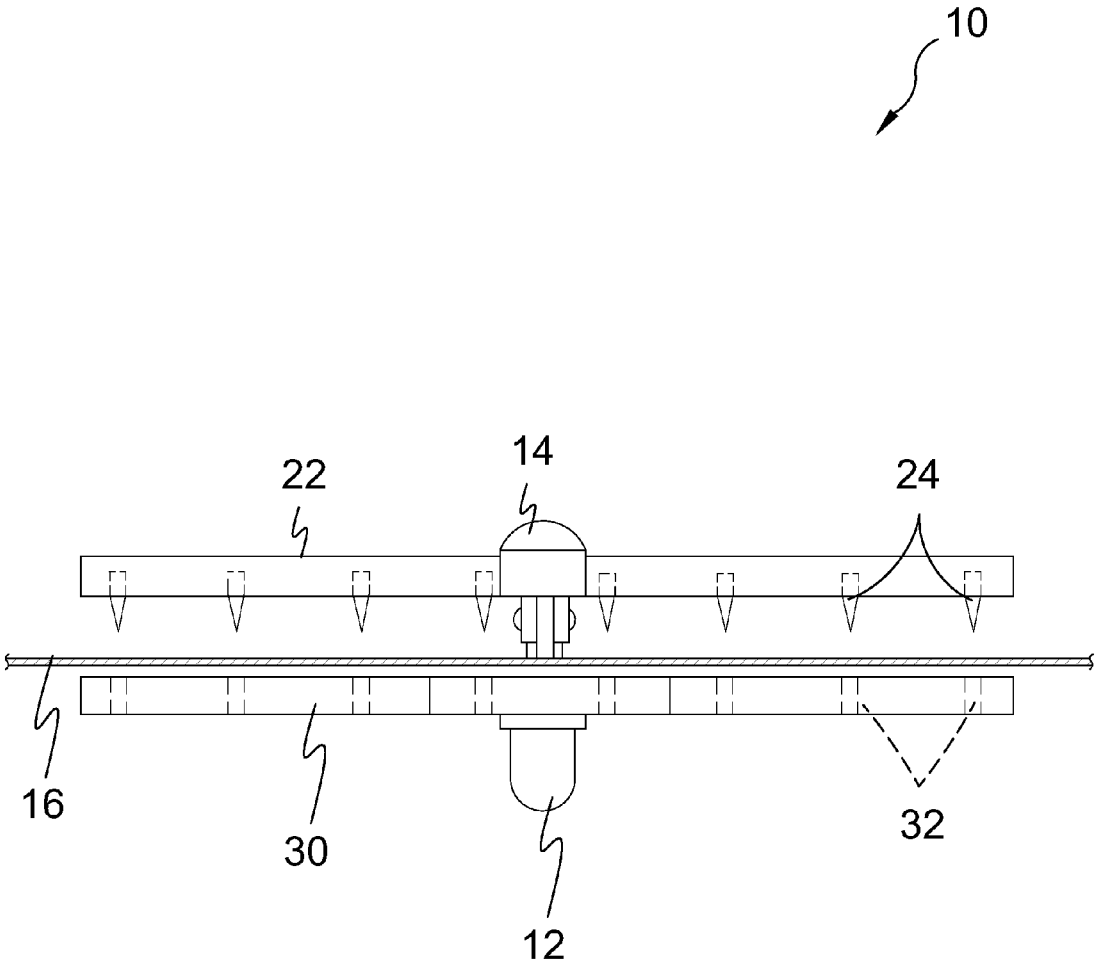
FIG. 9 is a front sectional view of the present invention in use.

FIG. 9 is a front sectional view of the present invention in use. Shown is the canvas stretching locking pliers 10 with the upper lateral plate 22 and the lower lateral plate 30 separated into the open position and the prongs 24 aligned with the prong apertures 32 with the canvas 16 placed therebetween.

Figure 10:
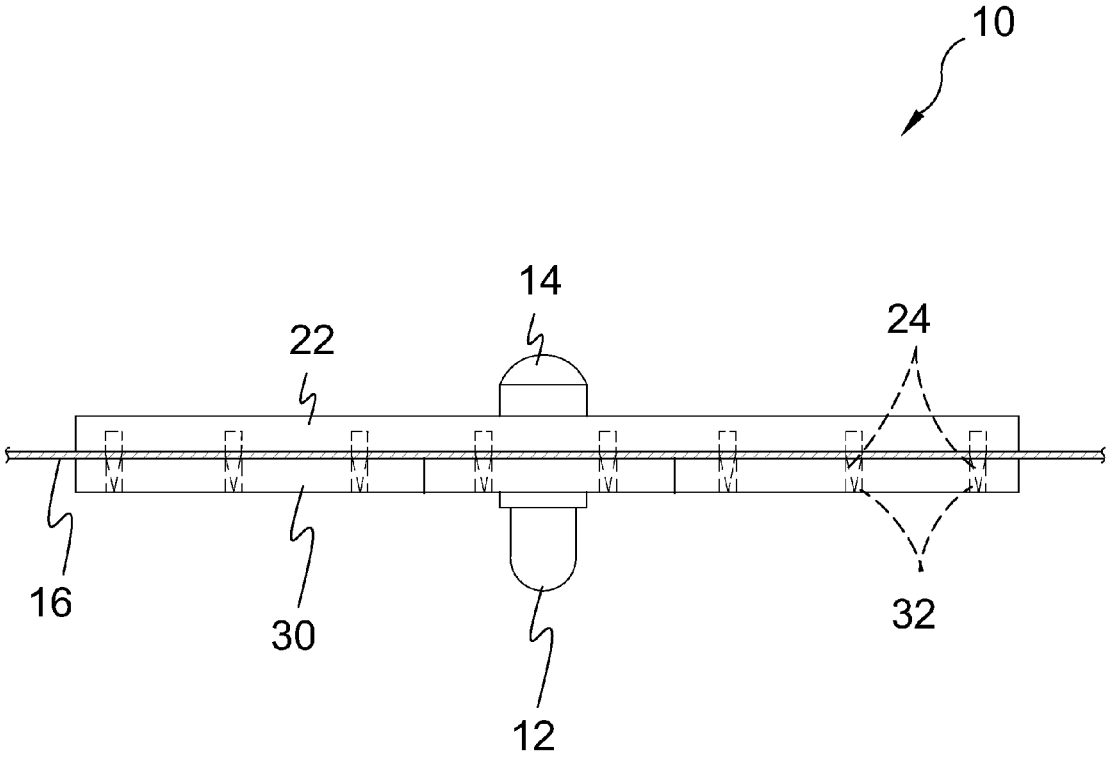
FIG. 10 is a front view present invention in use.

FIG. 10 is a front view present invention in use. Shown is the canvas stretching locking pliers 10 with the upper lateral plate 22 and the lower lateral plate 30 clamped into the closed position and the prongs 24 inserted within the prong apertures 32 with the canvas 16 crimped therebetween.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A canvas stretching locking tool for stretching a canvas across a stretcher frame comprising vice grip style canvas stretching locking pliers comprising:

a) a stationary articulating arm and a pivoting, locking articulating arm;

b) said pivoting, locking articulating arm disposed on the upper side of said tool when in use;

c) jaws affiliated on the distal ends of said articulating arms;

d) an upper lateral plate disposed on and integral with said upper jaw associated with said pivoting locking articulating arm, said upper lateral plate having a flat bottom surface, a pair of sides and a straight front side, and a raised bar on an upper side thereof along said straight front side;

e) a lower lateral plate disposed on and integral with said lower jaw associated with said stationary articulating arm, said lower lateral plate having a flat top surface, a pair of sides, and a front side;

f) a plurality of linearly spaced apart gripping elements disposed on the underside of said upper lateral plate;

g) apertures on said lower lateral plate for receiving said gripping elements, h) a fulcrum extension member extending forwardly from a portion of said front side of said lower lateral plate, said fulcrum extension member having a straight forward edge at a right angle to said flat top surface forming an upper straight fulcrum edge; and i) whereby when said pliers is locked onto said canvas wrapped over a stretcher bar of said stretcher frame and said upper straight fulcrum edge of said fulcrum extension member is placed against said stretcher bar rotation of said pliers will pull said canvas taut, said fulcrum edge being a fulcrum for said rotation.

2. The canvas stretching locking tool according to claim 1, wherein said gripping elements are a plurality of conical pointed prongs disposed on the underside of said upper lateral plate with bases thereof retained within said raised bar on the upper side thereof.

3. The canvas stretching locking tool according to claim 2, wherein said lower lateral plate includes a plurality of prong apertures disposed in the upper portion of said lower lateral plate for receiving said prongs therein.

4. The canvas stretching locking tool according to claim 1, wherein said fulcrum extension projects projecting from a medial portion of the front side of said lower lateral plate.

5. The canvas stretching locking tool according to claim 3, wherein said canvas is edge is placed between said upper and lower plates with said locking tool at an approximately 45 degree angle upwards and the pivoting locking arm is closed thereby piercing said canvas and securing it therebetween as the prongs enter said prong apertures.

6. The canvas stretching locking tool according to claim 5, wherein lowering said canvas stretching locking tool pulls said canvas to a uniform distance for fastening it to said stretcher frame due to the movement of said fulcrum extension against said stretcher bar.

7. The canvas stretching locking tool according to claim 6, wherein said canvas is secured to said stretcher frame with staples or tacks.

8. The canvas stretching locking tool according to claim 7, wherein said pivoting, locking arm is released and the tool is removed from said canvas.

9. Canvas stretching locking pliers for providing uniform stretching of a canvas over a stretcher frame comprising;

a) a stationary articulating arm and a pivoting, locking articulating arm disposed on the upper side thereof;

b) said pivoting, locking articulating arm disposed on the upper side of said pliers when in use;

c) jaws affiliated with distal ends of said articulating arms;

d) an upper lateral plate disposed on and integral with said upper jaw associated with said pivoting locking articulating arm;

e) a lower lateral plate disposed on said lower jaw associated with said stationary articulating arm;

f) a plurality of linearly spaced apart conical pointed prongs disposed on the underside of said upper lateral plate;

g) a raised bar disposed on an upper side of said upper lateral plate for retaining base portions of said prongs therein;

h) a plurality of prong apertures disposed on an upper side of said lower lateral plate for receiving said prongs therein; and i) a fulcrum extension projecting from a front portion of said lower lateral plate, said fulcrum extension having a straight corner forming a fulcrum for rotation of said pliers when pulling said canvas taut.

10. The canvas stretching locking pliers recited in claim 9, wherein the canvas is affixed to a stretcher bar of the stretcher frame, pulled across said frame, folded over the opposing stretcher bar and the canvas stretching locking pliers are applied to a central portion of said overlap and closed thereupon thus piercing said canvas and securing it between said upper and lower plates.

11. The canvas stretching locking pliers recited in claim 10, wherein said straight corner at a top edge of said fulcrum extension is placed against the stretcher bar with said pliers positioned at an approximately 45 degree angle therewith.

12. The canvas stretching locking pliers recited in claim 11, wherein said pliers are lowered to a substantially horizontal plane thereby stretching said canvas a predetermined distance equivalent to the length of said fulcrum extension.

13. The canvas stretching locking pliers recited in claim 12, wherein said canvas is secured to said stretcher bar with staples or tacks and said pliers are released and removed therefrom.

14. A method of utilizing canvas stretching pliers to stretch a canvas across a stretching frame comprising the steps:

a) providing a pair of vice grip like locking pliers comprising a stationary articulating arm and a pivoting, locking articulating arm disposed on the upper side thereof, a pivoting, locking articulating arm disposed on the upper side of said pliers when in use, jaws affiliated with the distal ends of said articulating arms, an upper lateral plate disposed on and integral with said upper jaw associated with said pivoting locking articulating arm, a lower lateral plate disposed on said lower jaw associated with said stationary articulating arm, a plurality of linearly spaced apart conical pointed prongs disposed on the underside of said upper lateral plate, a raised bar disposed on the upper side of said upper lateral plate for retaining base portions of said prongs therein, a plurality of prong apertures disposed on the upper side of said lower lateral plate for receiving said prongs therein; and a fulcrum extension projecting from the front portion of said lower lateral plate, said fulcrum extension having a straight corner forming a fixed fulcrum;

b) securing the canvas to a stretcher bar of a stretcher frame with staples or tacks;

c) pulling said canvas across said stretcher frame and wrapping it around the opposing stretcher bar;

d) holding said pliers at approximately a 45 degree angle and placing a central portion of said canvas between said upper lateral plate and said lower lateral plate;

e) placing the straight corner of said fulcrum extension against said stretcher bar;

f) closing said upper pivoting locking arm against said stationary arm thereby clamping said canvas between said upper lateral plate and said lower lateral plate and crimping said canvas into said prong apertures with said prongs;

g) lowering said pliers by rotating said pliers around said straight edge to a horizontal position thus pulling said canvas taut to a predetermined point;

h) securing said canvas to said stretcher bar using staples or tacks;

i) releasing said upper pivoting locking arm to release said plates from said canvas;

j) repeating the process working toward the corners of said stretcher frame; and k) repeating the process on the adjacent stretcher bars.

* * * * *